US008960651B2

(12) United States Patent
Harteveld et al.

(10) Patent No.: US 8,960,651 B2
(45) Date of Patent: Feb. 24, 2015

(54) VESSEL FOR COOLING SYNGAS

(75) Inventors: Wouter Koen Harteveld, Amsterdam (NL); Manfred Heinrich Schmitz-Goeb, Gummersbach (DE)

(73) Assignee: Shell Oil Company, Houston, TX (US)

( * ) Notice: Subject to any disclaimer, the term of this patent is extended or adjusted under 35 U.S.C. 154(b) by 1039 days.

(21) Appl. No.: 12/629,766

(22) Filed: Dec. 2, 2009

(65) Prior Publication Data

US 2010/0140817 A1 Jun. 10, 2010

Related U.S. Application Data

(60) Provisional application No. 61/120,985, filed on Dec. 9, 2008.

(30) Foreign Application Priority Data

Dec. 4, 2008 (EP) ..... 08170715

(51) Int. Cl.

| | |
|---|---|
| ***B01F 3/04*** | (2006.01) |
| ***C10J 3/48*** | (2006.01) |
| ***C10J 3/76*** | (2006.01) |
| ***C10J 3/84*** | (2006.01) |
| ***C10K 1/06*** | (2006.01) |
| ***F28C 3/06*** | (2006.01) |

(52) U.S. Cl.

CPC .. *C10J 3/485* (2013.01); *C10J 3/76* (2013.01); *C10J 3/84* (2013.01); *C10J 3/845* (2013.01); *C10K 1/06* (2013.01); *F28C 3/06* (2013.01); *C10J 2200/152* (2013.01)

USPC ..... 261/112.1; 261/121.1; 96/271; 96/272; 96/322; 96/327

(58) Field of Classification Search

USPC ..... 261/108, 112.1, 121.1; 96/271, 272, 96/273, 243, 322, 327

See application file for complete search history.

(56) References Cited

U.S. PATENT DOCUMENTS

| | | | | |
|---|---|---|---|---|
| 2,572,051 | A | 10/1951 | Parry | 48/203 |
| 2,896,927 | A | 7/1959 | Nagle et al. | 261/35 |

(Continued)

FOREIGN PATENT DOCUMENTS

| | | |
|---|---|---|
| BE | 448968 | 1/1948 |
| CA | 1168527 | 6/1984 |
| CN | 85104027 | 5/1985 |
| CN | 86103455 | 11/1986 |

(Continued)

OTHER PUBLICATIONS

"Shell Gasification Process", Oil and Gas Journal, Sep. 6, 1971, pp. 85-90.

(Continued)

*Primary Examiner* — Robert A Hopkins

(57) ABSTRACT

A vessel for cooling syngas comprising a syngas collection chamber and a quench chamber, wherein the syngas collection chamber has a syngas outlet which is fluidly connected with the quench chamber via a tubular diptube, wherein the syngas outlet comprises of a tubular part having a diameter which is smaller than the diameter of the tubular diptube and is co-axial with the diptube, and wherein the tubular part terminates at a point within the diptube such that an annular space is formed between the tubular part and the diptube, and wherein in the annular space a discharge conduit for a liquid water is present having a discharge opening located such to direct the liquid water along the inner wall of the diptube.

12 Claims, 2 Drawing Sheets

(56) References Cited

U.S. PATENT DOCUMENTS

| | | | | |
|---|---|---|---|---|
| 3,290,894 | A | 12/1966 | Tsao | |
| 3,537,977 | A | 11/1970 | Smith, Jr. | 208/89 |
| 3,684,689 | A | 8/1972 | Patton et al. | 208/54 |
| 3,988,421 | A | 10/1976 | Rinaldi | 423/210 |
| 4,054,424 | A | 10/1977 | Staudinger et al. | 48/210 |
| 4,165,274 | A | 8/1979 | Kwant | 208/93 |
| 4,202,672 | A | 5/1980 | Schuurman | 48/77 |
| 4,272,255 | A | 6/1981 | Coates | 48/63 |
| 4,272,256 | A | 6/1981 | Mitsak | 48/206 |
| 4,310,333 | A | 1/1982 | Schmidt et al. | |
| 4,328,007 | A | 5/1982 | Rafael | |
| 4,343,626 | A | 8/1982 | Peise et al. | 48/67 |
| 4,437,864 | A | 3/1984 | Gorris et al. | |
| 4,442,800 | A | 4/1984 | Seifert et al. | |
| 4,444,726 | A | 4/1984 | Crotty, Jr. et al. | 422/207 |
| 4,466,808 | A | 8/1984 | Koog | 48/197 R |
| 4,473,033 | A | 9/1984 | Strohmeyer, Jr. | 122/4 D |
| 4,474,584 | A | 10/1984 | Koog | |
| 4,494,963 | A | 1/1985 | Reich | 48/69 |
| 4,510,874 | A | 4/1985 | Hasenack | 110/347 |
| 4,523,529 | A | 6/1985 | Poll | 110/263 |
| 4,525,175 | A | 6/1985 | Stellaccio | 48/86 R |
| 4,525,176 | A | 6/1985 | Koog et al. | |
| 4,605,423 | A | 8/1986 | Koog | |
| 4,624,683 | A | 11/1986 | Dach | 48/69 |
| 4,666,463 | A | 5/1987 | Stellaccio | 48/197 R |
| 4,705,542 | A | 11/1987 | Gilmer | 55/93 |
| 4,731,097 | A | 3/1988 | Köhnen et al. | 48/76 |
| 4,775,392 | A | 10/1988 | Cordier et al. | 48/92 |
| 4,778,483 | A | 10/1988 | Martin et al. | 48/69 |
| 4,801,306 | A | 1/1989 | Denbleyker | 48/69 |
| 4,801,307 | A | 1/1989 | Muenger et al. | |
| 4,808,197 | A | 2/1989 | Ayers | |
| 4,809,625 | A | 3/1989 | Garcia-Mallol et al. | 110/347 |
| 4,818,252 | A | 4/1989 | Köhnen et al. | 48/67 |
| 4,818,253 | A | 4/1989 | Kohnen et al. | |
| 4,818,423 | A | 4/1989 | Steinbach et al. | 252/49.6 |
| 4,828,578 | A | 5/1989 | Den Bleyker | |
| 4,828,580 | A | 5/1989 | Dach | 48/69 |
| 4,852,997 | A | 8/1989 | Segerstrom et al. | 48/210 |
| 4,859,213 | A | 8/1989 | Segerstrom | 48/87 |
| 4,880,438 | A | 11/1989 | Den Bleyker | 48/69 |
| 4,887,962 | A | 12/1989 | Hasenack et al. | 110/263 |
| 4,936,871 | A | 6/1990 | Wilmer et al. | 48/197 R |
| 4,973,337 | A | 11/1990 | Jokisch et al. | 48/87 |
| 4,992,081 | A | 2/1991 | Den Bleyker | 48/69 |
| 5,069,755 | A | 12/1991 | Durr et al. | 202/169 |
| 5,133,941 | A | 7/1992 | Hays et al. | 422/140 |
| 5,152,976 | A | 10/1992 | Fong et al. | 423/652 |
| 5,248,316 | A | 9/1993 | Peise et al. | 48/76 |
| 5,271,243 | A | 12/1993 | Jelich | 62/304 |
| 5,293,843 | A | 3/1994 | Provol et al. | 122/4 D |
| 5,415,673 | A | 5/1995 | Hilton et al. | 48/197 R |
| 5,513,599 | A | 5/1996 | Nagato et al. | 122/4 D |
| 5,534,659 | A | 7/1996 | Springer et al. | 588/227 |
| 5,553,571 | A | 9/1996 | Campbell et al. | 122/379 |
| 5,570,645 | A | 11/1996 | Garcia-Mallol | 110/245 |
| 5,755,838 | A | 5/1998 | Tanaka et al. | 48/77 |
| 5,803,937 | A | 9/1998 | Hartermann et al. | 48/210 |
| 5,958,365 | A | 9/1999 | Liu | 423/655 |
| 5,968,212 | A | 10/1999 | Peise et al. | 48/101 |
| 5,976,203 | A | 11/1999 | Deeke et al. | 48/62 R |
| 6,283,048 | B1 | 9/2001 | Fujinami et al. | 110/346 |
| 6,311,629 | B1 | 11/2001 | Marschner et al. | 110/341 |
| 6,312,482 | B1 | 11/2001 | James et al. | 48/73 |
| 6,453,830 | B1 | 9/2002 | Zauderer | 110/345 |
| 6,562,102 | B1 | 5/2003 | Kepplinger et al. | 75/445 |
| 6,702,936 | B2 | 3/2004 | Rettger et al. | 208/86 |
| 6,755,980 | B1 | 6/2004 | Van den Born et al. | 210/767 |
| 6,808,653 | B1 | 10/2004 | Müller et al. | 252/374 |
| 7,037,473 | B1 | 5/2006 | Donner et al. | 422/242 |
| 7,163,647 | B2 | 1/2007 | Sanfilippo et al. | |
| 7,587,995 | B2 | 9/2009 | Kraft et al. | 122/7 R |
| 8,048,178 | B2 | 11/2011 | Smit et al. | |
| 8,052,864 | B2 | 11/2011 | Eilers et al. | |
| 2001/0020346 | A1 | 9/2001 | Schingnitz et al. | 48/127.9 |
| 2006/0070383 | A1 | 4/2006 | Drnevich et al. | 60/775 |
| 2006/0076272 | A1 | 4/2006 | Stil | 208/340 |
| 2006/0260192 | A1 | 11/2006 | Barot | 48/197 R |
| 2007/0011945 | A1 | 1/2007 | Grootveld et al. | 48/197 R |
| 2007/0062117 | A1 | 3/2007 | Schingnitz et al. | 48/210 |
| 2007/0079554 | A1 | 4/2007 | Schingnitz et al. | |
| 2007/0137107 | A1 | 6/2007 | Barnicki | 48/198.3 |
| 2007/0272129 | A1 | 11/2007 | Schilder | |
| 2007/0294943 | A1 | 12/2007 | Van Den Berg et al. | 48/208 |
| 2008/0005966 | A1 | 1/2008 | Fischer et al. | 48/210 |
| 2008/0141588 | A1 | 6/2008 | Kirchhubel et al. | |
| 2008/0172941 | A1* | 7/2008 | Jancker et al. | 48/73 |
| 2008/0222955 | A1 | 9/2008 | Jancker et al. | 48/67 |
| 2010/0140817 | A1 | 6/2010 | Harteveld et al. | 261/112.1 |
| 2010/0143216 | A1 | 6/2010 | Ten Bosch et al. | 422/207 |

FOREIGN PATENT DOCUMENTS

| | | |
|---|---|---|
| CN | 1209447 | 3/1999 |
| CN | 1639306 | 7/2002 |
| DE | 2342079 | 6/1975 |
| DE | 2425962 | 8/1978 |
| DE | 2935754 | 4/1980 |
| DE | 3009850 | 4/1983 |
| DE | 3809313 | 5/1989 |
| DE | 19643258 | 4/1998 |
| DE | 19829385 | 10/1999 |
| DE | 19952754 | 5/2001 |
| DE | 19957696 | 5/2001 |
| DE | 10004138 | 8/2001 |
| EP | 24281 | 4/1981 |
| EP | 127878 | 12/1984 |
| EP | 129737 | 1/1985 |
| EP | 160424 | 11/1985 |
| EP | 168128 | 1/1986 |
| EP | 291111 | 11/1988 |
| EP | 0374323 | 6/1990 |
| EP | 0379022 | 7/1990 |
| EP | 416242 | 7/1990 |
| EP | 400740 | 12/1990 |
| EP | 545281 | 6/1993 |
| EP | 551951 | 7/1993 |
| EP | 662506 | 9/1994 |
| EP | 759886 | 7/1998 |
| EP | 926441 | 6/1999 |
| EP | 683218 | 4/2001 |
| EP | 1499418 | 10/2003 |
| EP | 1373441 | 1/2004 |
| EP | 1450028 | 8/2004 |
| GB | 1413996 | 11/1975 |
| JP | 2003522020 | 7/2003 |
| JP | 2005002306 | 1/2005 |
| JP | 2005531673 | 10/2005 |
| SU | 839442 | 5/1974 |
| SU | 917700 | 3/1982 |
| SU | 1745990 | 6/1988 |
| WO | WO9317759 | 9/1993 |
| WO | WO9532148 | 11/1995 |
| WO | WO9603345 | 2/1996 |
| WO | WO9639354 | 12/1996 |
| WO | WO9722547 | 6/1997 |
| WO | WO9925648 | 5/1999 |
| WO | WO02079351 | 10/2002 |
| WO | WO2004005438 | 1/2004 |
| WO | WO2005025095 | 3/2005 |
| WO | WO2007125046 | 11/2007 |
| WO | WO2008065184 | 6/2008 |
| WO | 2008110592 | 9/2008 |
| WO | WO2008113766 | 9/2008 |

OTHER PUBLICATIONS

Kuhre, C. J., et al., Partial Oxidation Grows Stronger in U.S.; Shell Gasification Process, The Oil and Gas Journal, Sep. 6, 1971; pp. 85-90.

* cited by examiner

Fig.4
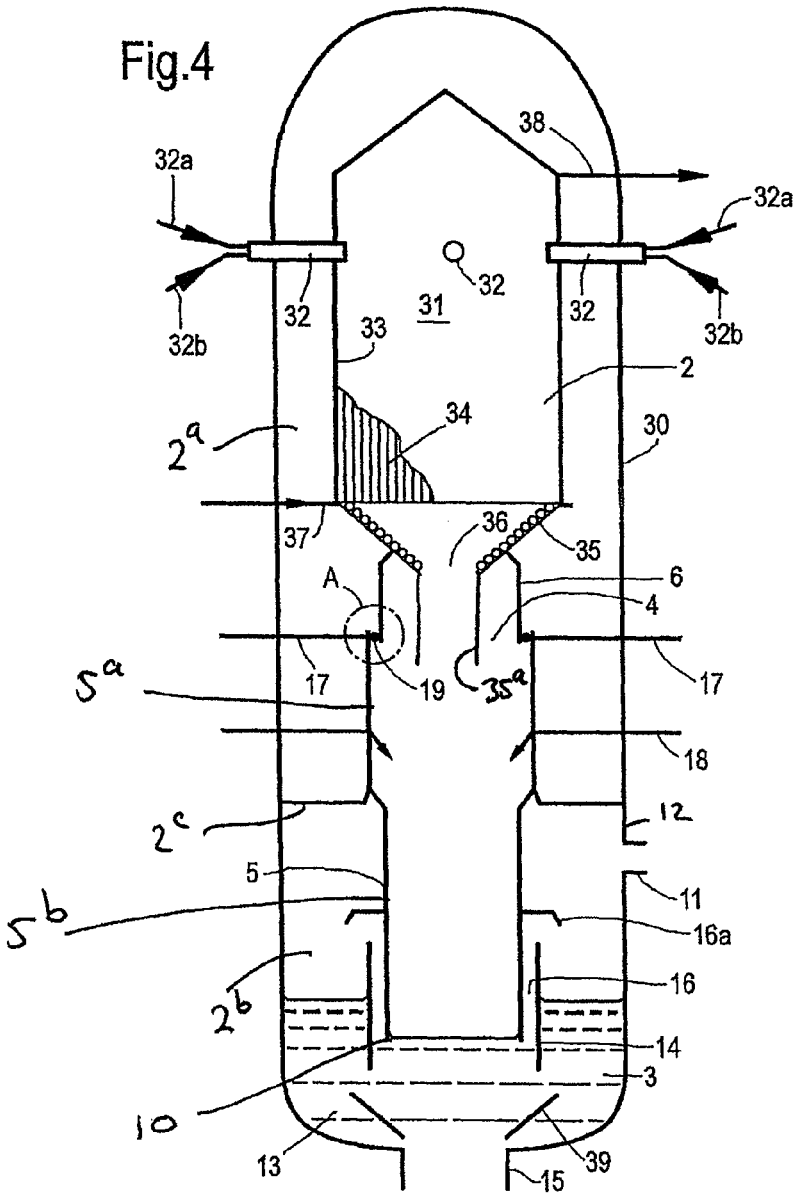
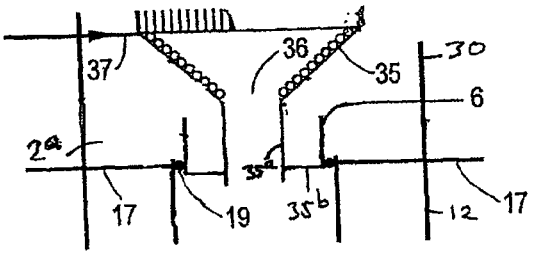
Fig.4a

VESSEL FOR COOLING SYNGAS

This application claims the benefit of European Application No. 08170715.0 filed Dec. 4, 2008 and U.S. Provisional Application No. 61/120,985 filed Dec. 9, 2008, both of which are incorporated herein by reference.

BACKGROUND OF THE INVENTION

The invention is directed to a vessel for cooling syngas comprising a syngas collection chamber and a quench chamber. The syngas outlet of the syngas collection chamber is fluidly connected with the quench chamber via a tubular diptube.

Such a vessel is described in U.S. Pat. No. 4,828,578. This publication describes a gasification reactor having a reaction chamber provided with a burner wherein a fuel and oxidant are partially oxidized to produce a hot gaseous product. The hot gases are passed via a constricted throat to be cooled in a liquid bath located below the reaction chamber. A diptube guides the hot gases into the bath. At the upper end of the diptube a quench ring is present. The quench ring has a toroidal body fluidly connected with a pressurized water source. A narrow channel formed in said body carries a flow of water to cool the inner wall of the diptube. The quench ring also has openings to spray water into the flow of hot gas as it passes the quench ring.

U.S. Pat. No. 4,808,197 discloses a combination diptube and quench ring, which is communicated with a pressurized source of a liquid coolant such as water and which directs a flow thereof against the diptube guide surfaces to maintain such surfaces in a wetted condition.

U.S. Pat. No. 4,474,584 describes a method of cooling a hot synthesis gas by contacting the gas downwardly through several contacting zones.

US 2008/0141588 describes a reactor for entrained flow gasification for operation with dust-type or liquid fuels having a cooling screen formed by tubes which are welded together in a gastight manner and through which cooling water flows.

U.S. Pat. No. 4,801,307 describes an assembly of a quench liquid distribution ring and diptube that includes an annular rectangular shaped bottom feed quench liquid distribution channel and surrounds the outside diameter of the diptube at its upstream end. A plurality of slot orifices pass through the inner wall of said annular distribution channel to provide free passage for the quench liquid between the distribution channel and the annular gap. A spiralling layer of quench liquid may be supplied to and distributed over the inside surfaces of the inner wall of the quench liquid distribution channel and the cylindrically shaped diptube.

US 2007/0272129 describes a spray ring for wetting char and/or slag in a water bath with a wetting fluid, the spray ring comprising a loop conduit arranged in a loop-line, which loop conduit is at an inlet point provided with an inlet for feeding the wetting fluid into the loop conduit in an inlet flow direction, and with a plurality of outlet openings for spraying the wetting fluid out of the loop conduit, wherein the inlet flow direction has a component that is tangential to a loop-line flow direction of the wetting fluid through the loop conduit at the inlet point. The included angle between the inlet flow direction and the loop-line flow direction in each inlet point is less than 90°, preferably less than 80° and more preferably less than 50°. The inlet angle may be 45°.

SUMMARY OF THE INVENTION

The present invention aims to provide an improved design for a vessel for cooling syngas comprising a syngas collection chamber and a quench chamber.

This is achieved by a vessel comprising a syngas collection chamber and a quench chamber, wherein the syngas collection chamber has a syngas outlet which is fluidly connected with the quench chamber via a tubular diptube, wherein the syngas outlet comprises a tubular part having a diameter which is smaller than the diameter of the tubular diptube and co-axial with the diptube, and wherein the tubular part terminates at a point within the diptube such that an annular space is formed between the tubular part and the diptube, and wherein in the annular space a discharge conduit for a liquid water is present having a discharge opening located such to direct the liquid water along the inner wall of the diptube, and wherein the discharge conduit has an extending part located away from the discharge opening, which extending part is fluidly connected to a vent conduit.

Applicants found that by providing the discharge conduit in the annular space a more robust design is obtained. The cooled tubular part functions as an effective heat shield, thereby protecting the discharge conduit against thermal stress.

BRIEF DESCRIPTION OF THE DRAWINGS

The invention and its preferred embodiments will be further described by means of the following figures.

FIG. 4 is a gasification reactor according to the invention.

FIG. 4*a* shows an alternative design for a section of the reactor of FIG. 4.

DETAILED DESCRIPTION

Syngas has the meaning of a mixture comprising carbon monoxide and hydrogen. The syngas is preferably prepared by gasification of an ash comprising carbonaceous feedstock, such as for example coal, petroleum coke, biomass and deasphalted tar sands residues. The coal may be lignite, bituminous coal, sub-bituminous coal, anthracite coal and brown coal. The syngas as present in the syngas collection chamber may have a temperature ranging from 600 to 1500° C. and have a pressure of between 2 and 10 MPa. The syngas is preferably cooled, in the vessel according the present invention, to below a temperature which is 50° C. higher than the saturation temperature of the gas composition. More preferably the syngas is cooled to below a temperature which is 20° C. higher than the saturation temperature of the gas composition.

Figure 1:
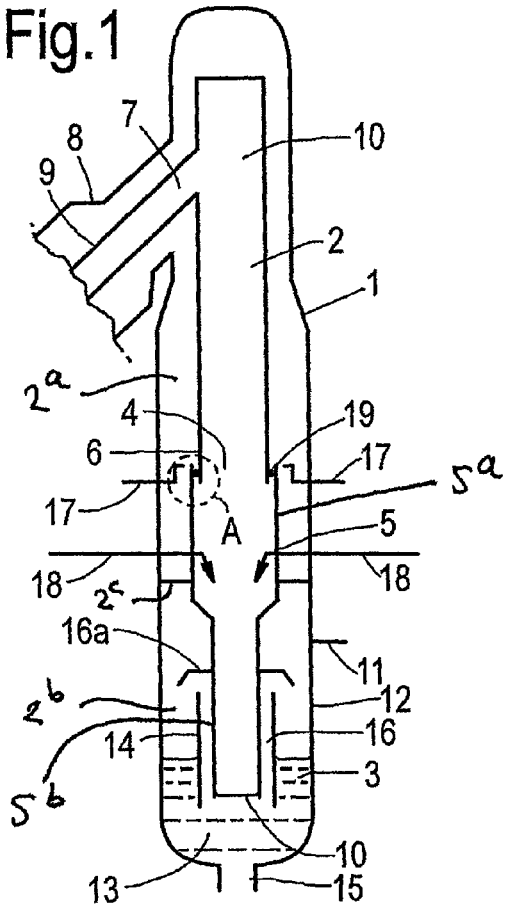
FIG. 1 is a cooling vessel according to the invention.
Figure 2:
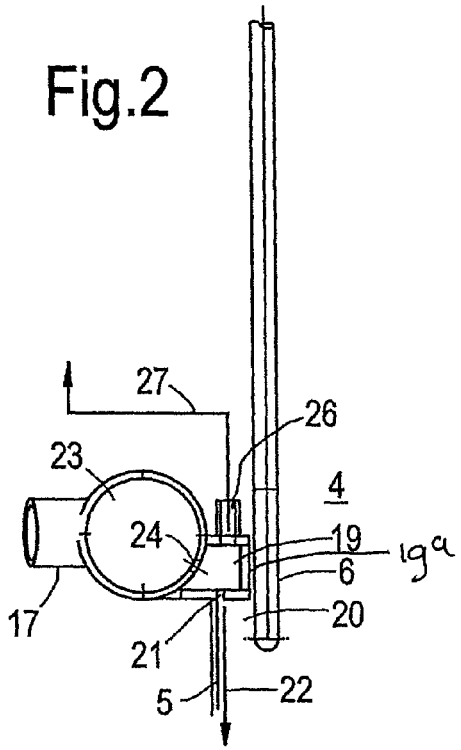
FIG. 2 is a side-view of detail A of FIG. 1.

FIG. 1 shows a vessel 1 comprising a syngas collection chamber 2 and a quench chamber 3. In use it is vertically oriented as shown in the Figure. References to vertical, horizontal, top, bottom, lower and upper relate to this orientation. Said terms are used to help better understand the invention but are by no means intended to limit the scope of the claims to a vessel having said orientation. The syngas collection chamber 2 has a syngas outlet 4, which is fluidly connected with the quench chamber 3 via a tubular diptube 5. The syngas collection chamber 2 and the diptube 5 have a smaller diameter than the vessel 1 resulting in an upper annular space 2*a* between said chamber 2 the wall of vessel 1 and a lower annular space 2*b* between the diptube 5 and the wall of vessel 1. Annular space 2*a* and 2*b* are preferably gas tight separated by sealing 2*c* to avoid ingress of ash particles from space 2*b* into space 2*a* and to avoid the gas by-passing the diptube via opening 19*a* (FIG. 2).

The syngas outlet 4 comprises a tubular part 6 having a diameter which is smaller than the diameter of the tubular diptube 5. The tubular part 6 is oriented co-axial with the diptube 5 as shown in the Figure. The vessel 1 as shown in FIG. 1 is at its upper end provided with a syngas inlet 7 and a connecting duct 8 provided with a passage 10 for syngas. The passage for syngas is defined by walls 9. Connecting duct 8 is preferably connected to a gasification reactor as described in more detail in WO-A-2007125046.

The diptube 5 is open to the interior of the vessel 1 at its lower end 10. This lower end 10 is located away from the syngas collection chamber 2 and in fluid communication with a gas outlet 11 as present in the vessel wall 12. The diptube is partly submerged in a water bath 13. Around the lower end of the diptube 5 a draft tube 14 is present to direct the syngas upwardly in the annular space 16 formed between draft tube 14 and diptube 5. At the upper discharge end of the annular space 16 deflector plate 16*a* is present to provide a rough separation between entrained water droplets and the quenched syngas. Deflector plate 16*a* preferably extends from the outer wall of the diptube 5. The lower part 5*b* of the diptube 5 preferably has a smaller diameter than the upper part 5*a* as shown in FIG. 1. This is advantageous because the layer of water in the lower end will increase and because the annular area for the water bath 13 will increase. This is advantageous because it enables one to use a more optimized, smaller, diameter for vessel 1. The ratio of the diameter of the upper part to the diameter of the lower part is preferably between 1.25:1 and 2:1. The quench zone 3 is further provided with an outlet 15 for water containing for example fly-ash and/or slag.

The tubular part 6 is preferably formed by an arrangement of interconnected parallel arranged tubes resulting in a substantially gas-tight tubular wall running from a cooling water distributor to a header. The cooling of tubular part 6 can be performed by either sub-cooled water or boiling water.

The walls of the syngas collection chamber 2 preferably comprises an arrangement of interconnected parallel arranged tubes resulting in a substantially gas-tight wall running from a distributor to a header, said distributor provided with a cooling water supply conduit and said header provided with a discharge conduit for water or steam. The walls of the diptube are preferably of a simpler design, like for example a metal plate wall.

FIG. 1 also shows preferred water spray nozzles 18 located in the diptube 5 to spray droplets of water into the syngas as it flows downwardly through the diptube 5. Also water supply conduit 17 and discharge conduit 19 are shown, which will be described in detail by means of FIGS. 2 and 3. The nozzles 18 are preferably sufficiently spaced away in a vertical direction from the discharge conduit 19 to ensure that any non-evaporated water droplets as sprayed into the flow of syngas will contact a wetted wall of the diptube. Applicants have found that if such droplets would hit a non-wetted wall ash may deposit, thereby forming a very difficult to remove layer of fouling. In an embodiment with a diptube 5 having a smaller diameter lower part 5*b* as discussed above it is preferred that the nozzles 18 are positioned in the larger diameter part 5*a*. More residence time is achieved by the larger diameter resulting in that the water as injected has sufficient time to evaporate.

FIG. 2 shows detail A of FIG. 1. FIG. 2 shows that the tubular part 6 terminates at a point within the space enclosed by the diptube 5 such that an annular space 20 is formed between the tubular part 6 and the diptube 5. In the annular space 20 a discharge conduit 19 for a liquid water is present having a discharge opening 21 located such to direct the liquid water 22 along the inner wall of the diptube 5. Conduit 19 and tubular part 6 are preferably not fixed to each other and more preferably horizontally spaced away from each other. This is advantageous because this allows both parts to move relative to each other. This avoids, when the vessel is used, thermal stress as both parts will typically have a different thermal expansion. The gap 19*a* as formed between conduit 19 and part 6 will allow gas to flow from the syngas collection chamber 2 to the space 2*a* between the wall of the chamber 2 and the wall of vessel 1. This is advantageous because it results in pressure equalization between said two spaces. The discharge conduit 19 preferably runs in a closed circle along the periphery of the tubular part 6 and has a slit like opening 21 as the discharge opening located at the point where the discharge conduit 19 and the inner wall of the diptube 5 meet. In use, liquid water 22 will then be discharged along the entire inner circumference of the wall of the diptube 5. As shown conduit 19 does not have discharge openings to direct water into the flow of syngas, which is discharged via syngas outlet 4.

FIG. 2 also shows that the discharge conduit 19 is suitably fluidly connected to a circular supply conduit 23. Said supply conduit 23 runs along the periphery of the discharge conduit 19. Both conduits 19 and 23 are fluidly connected by numerous openings 24 along said periphery. Alternatively, not shown in FIGS. 2 and 3, is an embodiment wherein the discharge conduit 19 is directly fluidly connected to one or more supply lines 17 for liquid water under an angle with the radius of the closed circle, such that in use a flow of liquid water results in the supply conduit.

Preferably the discharge conduit 19 or conduit 23 are connected to a vent. This vent is intended to remove gas, which may accumulate in said conduits. The ventline is preferably routed internally in the vessel 1 through the sealing 2*c* to be fluidly connected to annular space 2*b*. The lower pressure in said space 2*b* forms the driving force for the vent. The size of the vent line, for example by sizing an orifice in said ventline, is chosen such that a minimum required flow is allowed, possibly also carrying a small amount of water together with the vented gas into the annular space 2*b*. Preferably conduit 19 is provided with a vent as shown in FIG. 2, wherein the discharge conduit 19 has an extending part 26 located away from the discharge opening 21, which extending part 26 is fluidly connected to a vent conduit 27.

Figure 3:
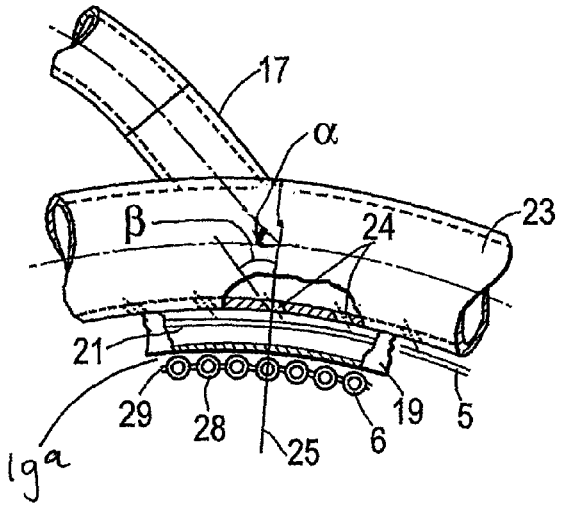
FIG. 3 is a top view of detail A of FIG. 1.

The circular supply conduit 23 of FIG. 3 is suitably fluidly connected to one or more supply lines 17 for liquid water under an angle $\alpha$, such that in use a flow of liquid water results in the supply conduit 23. Angle $\alpha$ is preferably between 0 and 45°, more preferably between 0 and 15°. The number of supply lines 17 may be at least 2. The maximum number will depend on the dimensions of for example the conduit 23. The separate supply lines 17 may be combined upstream and within the vessel 1 to limit the number of openings in the wall of vessel 1. The discharge end of supply line 17 is preferably provided with a nozzle to increase the velocity of the liquid water as it enters the supply conduit 23. This will increase the speed and turbulence of the water as it flows in conduit 23, thereby avoiding solids to accumulate and form deposits. The nozzle itself may be an easy to replace part having a smaller outflow diameter than the diameter of the supply line 17.

The openings 24 preferably have an orientation under an angle $\beta$ with the radius 25 of the closed circle, such that in use a flow of liquid water results in the discharge conduit 19 having the same direction has the flow in the supply conduit 23. Angle β is preferably between 45 and 90°.

FIG. 3 also shows tubular part 6 as an arrangement of interconnected parallel arranged tubes 28 resulting in a substantially gas-tight tubular wall 29.

FIG. 4 shows a vessel 30 according to the invention wherein the syngas collection chamber 2 is a reaction chamber 31 provided with 4 horizontally firing burners 32. The number of burners may suitably be from 1 to 8 burners. To said burners the carbonaceous feedstock and an oxygen containing gas are provided via conduits 32*a* and 32*b*. The wall 33 of the reaction chamber 31 is preferably an arrangement of interconnected parallel arranged tubes 34 resulting in a substantially gas-tight tubular wall. Only part of the tubes are drawn in FIG. 4. The tubes 34 run from a lower arranged cooling water distributor 37 to a higher arranged header 38. The burners 32 are arranged in FIG. 4 as described in for example WO-A-2008110592, which publication is incorporated by reference. The burners or burner may alternatively be directed downwardly as for example described in WO-A-2008065184 or in US-A-2007079554. In use a layer of liquid slag will be present on the interior of wall 33. This slag will flow downwards and will be discharged from the reactor via outlet 15.

The reference numbers in FIG. 4, which are also used in FIGS. 1-3, relate to features having the same functionality. Detail A in FIG. 4 refers to FIGS. 2 and 3.

The syngas outlet 4 consists of a frusto-conical part 35 starting from the lower end of the tubular wall 33 and diverging to an opening 36. Preferably part 35 has a tubular part 35*a* connected to the outlet opening of said part 35 to guide slag downwards into the diptube 5. This is advantageous because one then avoids slag particles to foul the discharge conduit 19. If such a tubular part 35*a* would not be present small slag particles may be carried to the conduit 19 and part 6 by recirculating gas. By having a tubular part of sufficient length such recirculation in the region of conduit 19 is avoided. Preferably the length of 35*a* is such that the lower end terminates at or below the discharge conduit 19. Even more preferably the lower end terminates below the discharge conduit 19, wherein at least half of the vertical length of the tubular part 35*a* extends below discharge conduit 19.

In FIG. 4*a* a preferred embodiment for tubular part 35*a* is shown, wherein the lower end of tubular 35*a* is fixed by a plane 35*b* extending to the lower end of the tubular part 6. This design is advantageous because less stagnant zones are present where solid ash particles can accumulate.

The frusto-conical part 35 and the optional tubular parts 35*a* and 35*b* comprise one or more conduits, through which in use boiling cooling water or sub-cooled cooling water, flows. The design of the conduits of parts 35, 35*a* and 35*b* may vary and may be for example spirally formed, parallel formed, comprising multiple U-turns or combinations. The part 35, 35*a* and 35*b* may even have separate cooling water supply and discharge systems. Preferably the temperature of the used cooling water or steam make of these parts 35 and 35*a* are measured to predict the thickness of the local slag layer on these parts. This is especially advantageous if the gasification process is run at temperatures, which would be beneficial for creating a sufficiently thick slag layer for a specific feedstock, such as low ash containing feedstocks like certain biomass feeds and tar sand residues. Or in situations where a coal feedstock comprises components that have a high melting point. The danger of such an operation is that outlet 4 may be blocked by accumulating slag. By measuring the temperature of the cooling water or the steam make one can predict when such a slag accumulation occurs and adjust the process conditions to avoid such a blockage. The invention is thus also directed to a process to avoid slag blockage at the outlet of the reaction chamber in a reactor as described by FIG. 4 by measuring the temperature of the cooling water or the steam make of these parts 35 and 35*a* in order to predict when a slag blockage could occur and adjust the process conditions to avoid such a blockage. Typically a decrease in temperature of the used cooling water or a decrease in steam make are indicative of a growing layer of slag. The process is typically adjusted by increasing the gasification temperature in the reaction chamber such that the slag will become more fluid and consequently a reduction in thickness of the slag layer on parts 35 and 35*a* will result. The supply and discharge conduits for this cooling water are not shown in FIG. 4.

The frusto-conical part 35 is connected to the tubular part 6 near its lower end. Opening 36 has a smaller diameter than the diameter of the tubular part 6 such that liquid slag will less easily hit the wall of the tubular part 6 and or of the diptube 5 when it drops down into the water bath 13 and solidifies. In water bath 13 the solidified slag particles are guided by means of an inverted frusto-conical part 39 to outlet 15.

What is claimed is:

1. A vessel for cooling syngas comprising a syngas collection chamber and a quench chamber, wherein the syngas collection chamber has a syngas outlet which is fluidly connected with the quench chamber via a tubular diptube, wherein the syngas outlet comprises a tubular part having a diameter which is smaller than the diameter of the tubular diptube and is co-axial with the diptube, and wherein the tubular part terminates at a point within the diptube such that an annular space is formed between the tubular part and the diptube, wherein in the annular space a discharge conduit for a liquid water is present having a discharge opening located such to direct the liquid water along the inner wall of the diptube, and wherein the discharge conduit has an extending part located away from the discharge opening, which extending part is fluidly connected to a vent conduit.

2. A vessel according to claim 1, wherein the vent conduit is fluidly connected to an annular space as present between the diptube and the wall of the vessel.

3. A vessel according to claim 1, wherein the tubular part is formed by an arrangement of interconnected parallel arranged tubes resulting in a gas-tight tubular wall running from a cooling water distributor to a header.

4. A vessel according to claim 1, wherein the discharge conduit runs in a closed circle along the periphery of the tubular part and has a slit like opening located at the point where the discharge conduit and the inner wall of the diptube meet, such that in use, liquid water is discharged along the entire inner circumference of the wall of the diptube.

5. A vessel according to claim 4, wherein the discharge conduit is fluidly connected to one or more supply lines for liquid water under an angle with the radius of the closed circle, such that in use a flow of liquid water results in the supply conduit.

6. A vessel according to claim 4, wherein the discharge conduit is fluidly connected to a circular supply conduit which runs along the periphery of the discharge conduit and wherein both conduits are fluidly connected by numerous openings along said periphery and wherein the circular supply conduit is fluidly connected to one or more supply lines for liquid water under an angle with the radius of the closed circle, such that in use a flow of liquid water results in the supply conduit.

7. A vessel according to claim 6, wherein the discharge end of the supply line is provided with a nozzle to increase the velocity of the liquid water as it enters the supply conduit.

8. A vessel according to claim 6, wherein the angle between the circular supply conduit and the supply lines is between 0 and 45°.

9. A vessel according to claim 6, wherein the openings between the discharge conduit and the supply conduit are channels having an orientation under an angle with the radius of the closed circle, such that in use a flow of liquid water results in the discharge conduit having the same direction as the flow in the supply conduit.

10. A vessel according to claim 9, wherein the angle between the radius of the circular discharge conduit and the channels is between 45 and 90°.

11. A vessel according to claim 1, wherein the syngas collection chamber comprises an arrangement of interconnected parallel arranged tubes resulting in a gas-tight wall running from a distributor to a header, said distributor provided with a cooling water supply conduit and said header provided with a steam discharge conduit.

12. A vessel according to claim 1, wherein the tubular part and the discharge conduit are spaced away from each other such that the annular space between the syngas collection chamber and the wall of the vessel are fluidly connected with the space enclosed by the syngas collection chamber.

* * * * *